United States Patent [19]

Miyazi et al.

[11] 4,164,637

[45] Aug. 14, 1979

[54] DUAL TREAD PLATE FOOT SWITCH

[75] Inventors: Kazumi Miyazi, Fuchu; Hiroki Ichikawa, Hachioji, both of Japan

[73] Assignee: Olympus Optical Co., Ltd., Tokyo, Japan

[21] Appl. No.: 883,797

[22] Filed: Mar. 6, 1978

[30] Foreign Application Priority Data

| | | | |
|---|---|---|---|
| Mar. 10, 1977 | [JP] | Japan | 52-29255[U] |
| Mar. 15, 1977 | [JP] | Japan | 52-31647[U] |
| Mar. 18, 1977 | [JP] | Japan | 52-34177[U] |

[51] Int. Cl.[2] ..... H01H 13/16

[52] U.S. Cl. ..... 200/86.5; 200/86 R; 200/153 C

[58] Field of Search ..... 116/DIG. 28; 200/61.89, 200/86.5, 153 C, 153 T, 159 R, 333, 339, 340, 5 A, 18, 293, 86 R, 295

[56] References Cited

U.S. PATENT DOCUMENTS

| | | | |
|---|---|---|---|
| 3,784,765 | 1/1974 | Daly | 200/18 |
| 3,867,591 | 2/1975 | Nordeen | 200/86.5 |
| 3,916,150 | 10/1975 | Abernathy | 200/340 |
| 3,918,391 | 11/1975 | Hadfield | 116/DIG. 28 |
| 3,928,741 | 12/1975 | Comer | 200/5 A |
| 4,032,729 | 6/1977 | Koistinen | 200/5 A |

*Primary Examiner*—Gerald P. Tolin
*Attorney, Agent, or Firm*—Flynn & Frishauf

[57] ABSTRACT

A foot switch includes a lower case made of a synthetic resin and having an engaging bent portion on an integrally formed strip; and a tread plate made of a synthetic resin and having an integrally formed strip with an engaging slit in which the engaging bent portion is inserted. A microswitch is operated when the tread plate is downwardly pressed by a foot.

14 Claims, 12 Drawing Figures

DUAL TREAD PLATE FOOT SWITCH

BACKGROUND OF THE INVENTION

This invention relates to a foot switch and more particularly a foot switch for transcribers and similar devices.

While listening to what is being reproduced by a transcriber from a recorded magnetic tape, a typist types the information recorded on the tape. Since the typist uses both hands while typing the information, a foot switch is used to start and stop the operation of the transcriber.

A known foot switch for transcribers and the like is constituted chiefly by, as shown in FIG. 1, a rectangular box-shaped tread plate 1 and a rectangular box-shaped lower case 2 covered by the tread plate 1. From the inner surface of the tread plate 1 there protrude downwardly two stepped rods 3*a* and 3*b*. The stepped rod 3*a* consists of a thicker base portion 4*a* and a thinner end portion 5*a*, and the stepped rod 3*b* consists of a thicker base portion 4*b* and a thinner end portion 5*b*.

The bottom portions of the lower case 2 which face the rods 3*a* and 3*b* are pressed up by the well known press techniques to form two hollow cylinders 6*a* and 6*b*, respectively. These hollow cylinders 6*a* and 6*b* have an outer diameter equal to the diameter of the base portions 4*a* and 4*b* of the rods 3*a* and 3*b*. The upper surfaces 7*a* and 7*b* of the cylinders 6*a* and 6*b* have through holes 8*a* and 8*b*, respectively. The holes 8*a* and 8*b* are large enough to receive the end portions 5*a* and 5*b* of the rods 3*a* and 3*b*. From within the hollows 9*a* and 9*b* of the cylinders 6*a* and 6*b* two screws 11*a* and 11*b* are screwed through washers 10*a* and 10*b* into threaded holes 12*a* and 12*b* bored in the end portions 5*a* and 5*b* of the rods 3*a* and 3*b*, respectively.

A compression coil spring 13*a* is held by the corresponding base portion 4*a* and hollow cylinder 6*a*, and another compression coil spring 13*b* by the corresponding base portion 4*b* and hollow cylinder 6*b*. These coil springs 13*a* and 13*b* urge the tread plate 1 upwardly to keep it spaced apart from the lower case 2. On the central part of the bottom of the lower case 2 there is provided a microswitch 13 of well known type. The microswitch 13 has on its top a member 14 which closes the switch 13 when depressed.

Such a foot switch as mentioned above is placed under the typist's foot. When the typist treads on the tread plate 1, the member 14 closes the microswitch 13, thus causing the transcriber to start reproducing the information recorded on the magnetic tape. To manufacture such foot switch, however, press techniques should be employed. Moreover, the foot switch is constituted by a relatively large number of parts. Consequently it is extremely cumbersome to manufacture the foot switch.

SUMMARY OF THE INVENTION

An object of this invention is to provide a foot switch which can be easily manufactured and which can be easily overhauled with an ordinary tool such as a screw driver.

DESCRIPTION OF THE PREFERRED EMBODIMENTS

An embodiment of the invention will be described with reference to FIGS. 2 to 4.

Figure 1:
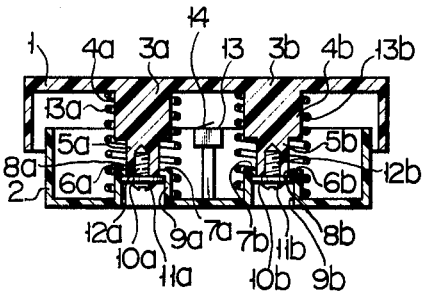
FIG. 1 PRIOR ART
FIG. 1 is a cross-sectional view of a prior art foot switch.
Figure 2:
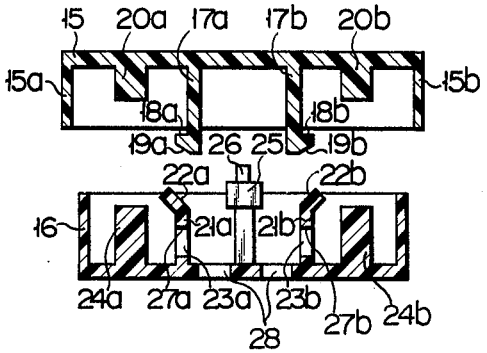
FIGS. 2 to 4 show a foot switch according to one embodiment of this invention, FIG. 2 being a cross-sectional view of the parts before they are assembled, FIG. 3 being a perspective view of the parts before they are assembled and FIG. 4 being a cross-sectional view of the completed switch.
Figure 3:
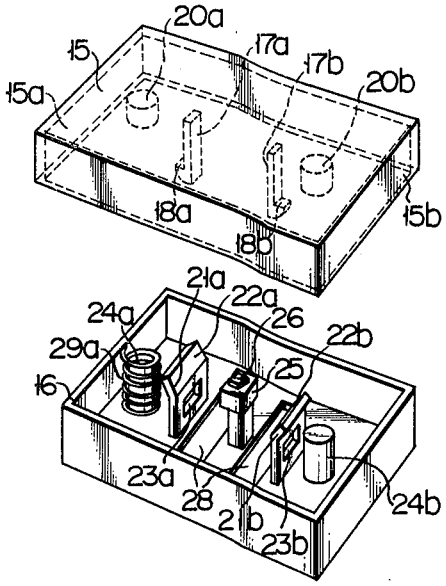
Figure 4:
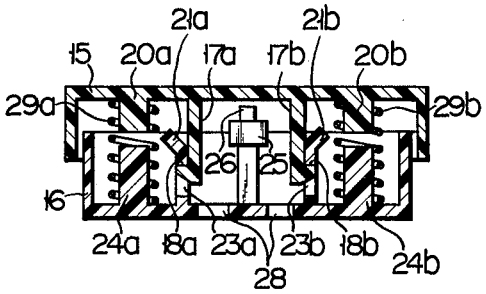

The foot switch as illustrated in FIGS. 2 to 4 comprises a tread plate 15 and a lower case 16 which are made of synthetic resin. The lower case 16 is a rectangular box with the upper side open. The tread plate 15 is so shaped and sized that it loosely covers the opening of the lower case 16. From the inner surface of the tread plate 15 there protrude two first engagement strips 17*a* and 17*b* parallel to each other. The end portions of these strips 17*a* and 17*b* are so bent in opposite directions as to form hooks 18*a* and 18*b*, which have faces 19*a* and 19*b* inclined to the axes of the strips 17*a* and 17*b*. The first engagement strips 17*a* and 17*b* are made of a synthetic resin and are integrally formed with the tread plate 15. The strips 17*a* and 17*b* are therefore elastic and can bend in any direction. Further, from the inner surface of the tread plate 15 between the strip 17*a* and the left side wall 15*a*, a solid cylinder 20*a* extends downwardly. Similarly, another solid cylinder 20*b* extends downwardly from the inner surface of the tread plate 15 between the strip 17*b* and the right side wall 15*b* of the tread plate 15. These cylinders 20*a* and 20*b* are integrally formed with the tread plate 15 and serve to hold springs 29*a* and 29*b*, respectively, as shown in FIG. 4.

On the bottom parts of the lower case 16 which face the first engagement strips 17*a* and 17*b* there stands upright two second engagement strips 21*a* and 21*b* which are integrally formed with the lower case 16. The end portions 22*a* and 22*b* of these strips 21*a* and 21*b* are bent in opposite directions, the portion 22*a* to the left and the portion 22*b* to the right. The strip 21*a* has a rectangular window 23*a* just below the inclined end portion 22*a*, and the strip 21*b* has a rectangular window 23*b* just below the inclined end portion 22*b*. The upper edges 27*a* and 27*b* of the windows 23*a* and 23*b* are to abut with the hooks 18*a* and 18*b* of the tread plate 15, respectively. Further, on the bottom parts of the lower case 16 which face the solid cylinders 20*a* and 20*b* of the tread plate 15 there stand upright solid cylinders 24*a* and 24*b*. The cylinders 24*a* and 24*b* are integrally formed with the lower case 15 and serve to hold the springs 29*a* and 29*b*, respectively, as shown in FIG. 4.

Against the force of the springs 29*a* and 29*b* the tread plate 15 may be depressed until the solid cylinders 20*a* and 20*b* come into contact with the solid cylinders 24*a* and 24*b*, respectively. Thus, the cylinders 20*a*, 20*b*, 24*a* and 24*b* act as stoppers for the tread plate 15.

On the central bottom parts of the lower case 16 there is provided a microswitch 25 of well known type. The microswitch 25 has on its top a push member 26, which closes the switch 25 when depressed.

The bottom of the lower case 16 has two rectangular through holes 28, one on one side of the microswitch 25 and the other on the other side of the microswitch 25. Though these holes 28 a screw driver or a similar tool may be inserted in order to release the hooks 18*a* and 18*b* from the windows 27*a* and 27*b*, respectively.

It will now be explained how the tread plate 15 and the lower case 16 are put together to constitute the foot switch and how the foot switch operates.

First, one end of the spring 29*a* is held by the solid cylinder 20*a* of the tread plate 15, and one end of the spring 29*b* by the solid cylinder 20*b* of the tread plate 15. Then the other ends of the springs 29*a* and 29*b* are held by the solid cylinders 24*a* and 24*b* of the lower case 16, respectively. Thus the tread plate 15 is placed in such a position as to cover the opening of the lower case 16. Thereafter the tread plate 15 is pushed down against the force of the springs 29*a* and 29*b*. As the tread plate 15 is gradually depressed, the inclined faces 19*a* and 19*b* of the hooks 18*a* and 18*b* slide on the inclined end portions 22*a* and 22*b* of the second engagement strips 21*a* and 21*b*, while the first engagement strips 17*a* and 17*b* are so bent against their own elastic force as to cause the hooks 18*a* and 18*b* to approach each other. This continues until the hooks 18*a* and 18*b* snap into the windows 23*a* and 23*b* of the second engagement strips 21*a* and 21*b*, respectively. Once the hooks 18*a* and 18*b* have been fitted into the windows 23*a* and 23*b*, the first engagement strips 17*a* and 17*b* become straight again as shown in FIG. 4.

Thereafter, both hooks 18*a* and 18*b* remain in contact with the upper edges 27*a* and 27*b* of the windows 23*a* and 23*b* even if the downward force is removed from the tread plate 15. Thus the tread plate 15 never disengages from the lower case 16 so long as the hooks 18*a* and 18*b* are kept in contact with the window upper edges 27*a* and 27*b*, respectively.

The foot switch thus assembled is placed under a typist's foot. When the typist treads the tread plate 15, the member 26 closes the microswitch 25, which in turn brings a transcriber into operation. So long as the typist keeps depressing the tread plate 15, the transcriber continues to reproduce the information recorded on the tape. Thus, to stop the operation of the transcriber, the typist lifts his foot from the tread plate 15. Then the springs 29*a* and 29*b* push up the tread plate 15, the push member 26 opens the microswitch 25, and finally the transcriber stops its function.

Figure 5:
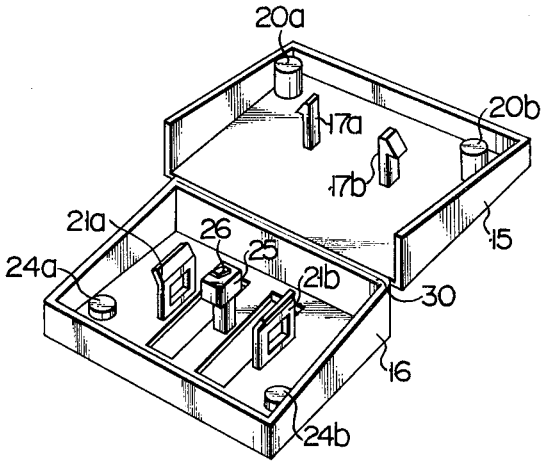
FIGS. 5 to 7 show another embodiment of this invention, FIG. 5 being a perspective view of the parts before they are assembled, FIG. 6 being a cross-sectional view of the parts before they are assembled and FIG. 7 being a cross-sectional view of the completed switch.
Figure 6:
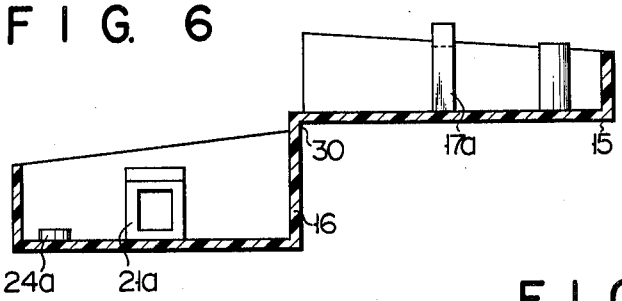
Figure 7:
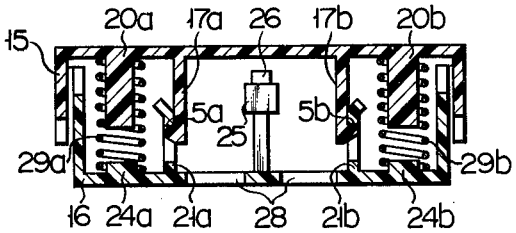

The foot switch shown in FIGS. 2 to 4 is comprised of a tread plate and a lower case which are formed separately. Instead a tread plate and a lower case may be formed integrally as illustrated in FIGS. 5 to 7. The embodiment shown in FIGS. 5 to 7 is constructionally identical with the foot switch shown in FIGS. 2 to 4 except in that the tread plate 15 is hinged to the lower case 16 by a hinge 30 and can swing by at least 180°. The tread plate 15, the lower case 17 and the hinge 30 are integrally formed together and made of a synthetic resin.

The foot switch as shown in FIGS. 5 to 7 operates in the same manner as does the foot switch illustrated in FIGS. 2 to 4. It will now be explained how the tread plate 15 and the lower case 15 are assembled.

First, one end of a spring 29*a* is held by the solid cylinder 20*a* of the tread plate 15, and one end of a spring 29*b* by the solid cylinder 20*b* of the tread plate 15. Then the tread plate 15 is swung so as to cover the opening of the lower case 16, whereby the other ends of the springs 29*a* and 29*b* are held by the solid cylinders 24*a* and 24*b* of the lower case 16, respectively. This done, the tread plate 15 is pushed down. As the tread plate 15 is gradually depressed, the inclined faces 19*a* and 19*b* of the hooks 18*a* and 18*b* slide on the inclined end portions 22*a* and 22*b* of the second engagement strips 21*a* and 21*b*, while the first engagement strips 17*a* and 17*b* are so bent against their own elastic force as to make the hooks 18*a* and 18*b* approach each other. This continues until the hooks 18*a* and 18*b* snap into the windows 23*a* and 23*b* and come into engagement with the upper edges 27*a* and 27*b* of the windows 23*a* and 23*b*, respectively. Once the hooks 18*a* and 18*b* have been fitted into the windows 23*a* and 23*b*, the first engagement strips 17*a* and 17*b* become straight again as shown in FIG. 7.

Thereafter, both hooks 18*a* and 18*b* remain in contact with the upper edges 27*a* and 27*b* of the windows 23*a* and 23*b* even if the downward force is removed from the tread plate 15. In this way the tread plate 15 and the lower case 16 are put together to form a foot switch. The tread plate 15 never swings open so long as the hooks 18*a* and 18*b* are kept in contact with the window upper edges 27*a* and 27*b*, respectively.

The tread plate 15 in such state as shown in FIG. 7 can be further depressed until the cylinders 20*a* and 20*b* come into contact with the cylinders 24*a* and 24*b* of the lower case 16. The windows 23*a* and 23*b* are so positioned that the hooks 18*a* and 18*b* move but remain in the windows 23*a* and 23*b* during such further depression of the tread plate 15.

As in the embodiment of FIGS. 2 to 4, the bottom of the lower case 15 has two through holes 28. To make the tread plate 15 swing open, a screw driver or a similar tool is inserted through the holes 28 so as to release the hooks 18*a* and 18*b* from the edges 27*a* and 27*b* of the windows 23*a* and 23*b*. In this way the tread plate 15 can be easily swung open.

In both the embodiment of FIGS. 2 to 4 and the embodiment of FIGS. 5 to 7, the first engagement strips 17*a* and 17*b* are integrally formed with the tread plate 15 and the second engagement strips 21*a* and 21*b* are integrally formed with the lower case 16. Instead, the first engagement strips 17*a* and 17*b* may be integrally formed with the lower case 16, and the second engagement strips 21*a* and 21*b* with the tread plate 15. Further, the engagement mechanism of both embodiments achieves engagement between a hook and a hole. Instead of such engagement mechanism, use may be made of a mechanism which effects engagement between a hook and a hook.

With reference to FIGS. 8 to 12, another embodiment of this invention will be described, which can alternatively carry out play switching and back space switching.

The foot switch of FIGS. 8 to 11 comprises a play tread plate 34, a back space tread plate 35 and a lower case 36. The play tread plate 34 is shaped like a box cover, and the back space tread plate 35 is a rectangular plate cut out from the plate 34, hinged thereto and inclined thereto at about 15°. The lower case 36 is a box with its upper side open and is so shaped that its opening is covered fully by the tread plates 34 and 35.

Figure 8:
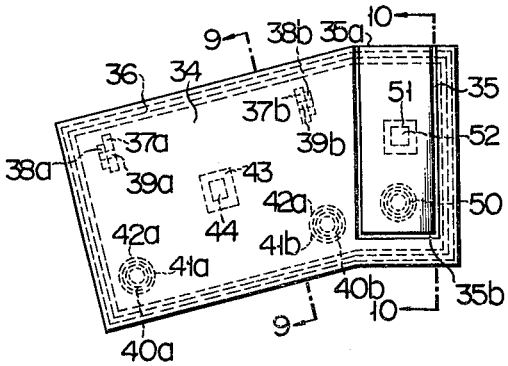
FIGS. 8 to 11 show a foot switch according to still another embodiment of this invention, FIG. 8 being a plan view, FIG. 9 being a cross-sectional view taken along line 9—9 in FIG. 8, FIG. 10 being a cross-sectional view taken along line 10—10 in FIG. 8 and FIG. 11 being a perspective view.

From the inner surface of the tread plate 34 there protrude two strips 37*a* and 37*b* in the upper-left corner and the upper-right corner, respectively, as illustrated in FIG. 8. On the bottom parts of the lower case 36 which face the strips 37*a* and 37*b* there stand two strips 38*a* and 38*b*. The strips 37*a* and 38*a* are loosely fastened by a pin 39*a*, and so are the strips 37*b* and 38*b* by a pin 39*b*. Thus the play tread plate 34 can rock about the pins 39*a* and 39*b*.

Further, on the inner surface of the tread plate 34 two stepped cylinders 41*a* and 41*b* are provided in the lower-left corner and the lower-right corner, respectively, as shown in FIG. 8. On the bottom parts of the lower case 36 two similar stepped cylinders 42*a* and 42*b* are provided in such positions as to face the stepped cylinders 41*a* and 42*b*, respectively. A coil spring 40*a* is held between the mutually facing cylinders 41*a* and 42*a*, and another coil spring 40*b* between the mutually facing cylinders 41*b* and 42*b*. These springs 40*a* and 40*b* cooperate to urge the play tread plate 34 upwardly so as to keep a microswitch 43 (later described) in an open state.

The microswitch 43 is provided on the central part of the bottom of the lower case 35. The microswitch 43 has a push member 44 on its top. The push member 44 closes the microswitch 43 when the play tread plate 34 is depressed against the force of the springs 40*a* and 40*b* and thus pushes down member 44.

The play tread plate 34 can be depressed until the stepped cylinders 41*a* and 41*b* come into contact with the stepped cylinders 42*a* and 42*b*, respectively. Once these cylinders have touched, the play tread plate 34 cannot be pushed down further. The stepped cylinders 41*a*, 41*b*, 42*a* and 42*b* therefore act as stoppers to limit the depression of the play tread plate 34.

Figure 11:
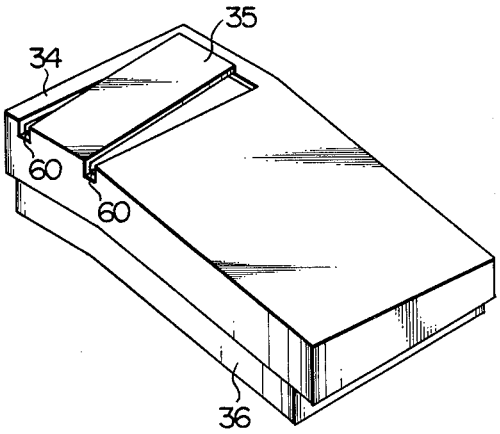
Figure 9:
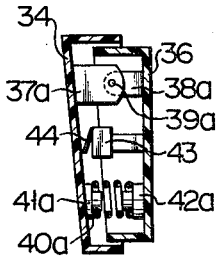
Figure 10:
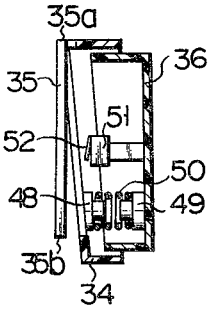

As shown in FIG. 8, the back space tread plate 35 is cut out of the right portion of the play tread plate 34 and inclined at about 15° to the plate 34. Its rear edge 35*a* is integral with the play tread plate 34 and thus acts as a hinge. On both sides of the hinge portion 35*a* slits 60 are each formed in the play tread plate 34 as shown in FIG. 11 so that the back space tread plate 35 can rock about the hinge portion 35*a* more smoothly than otherwise.

On the inner surface of the back space plate 35 a stepped cylinder 48 is provided near the front edge 35*b* opposite to the hinge portion 35*a*. Similary, on the bottom of the lower case 36 a stepped cylinder 49 is provided in such a position as to face the stepped cylinder 48. Between these stepped cylinders 48 and 49 there is held a coil spring 50. The spring 50 urges the back space tread plate 35 to rock upward about the hinge portion 35*a* to such extent that the back space tread plate 35 is positioned normally above the surface of the play tread plate 34.

A microswitch 51 is provided on the bottom of the lower case 36 in such a position as to face the central part of the back space tread plate 35. The microswitch 51 has a push member 52 on its top. The push member 52 closes the switch 51 when the back space tread plate 36 is depressed against the force of the spring 50 and thus pushes down the push member 52.

The spring 50 urging upward the back space tread plate 35 has a greater elastic force than the sum of the elastic forces of the springs 40*a* and 40*b* which urge the play tread plate 34. Thus when only the play tread plate 34 is treaded, the front edge 35*b* of the back space tread plate 35 is never depressed to such extent as to close the microswitch 51. On the other hand, when only the back space tread plate 35 is treaded, the downward force on the plate 35, which is strong, propagates to the play tread plate 34 through the hinge portion 35*a*. As a result, the play tread plate 34 is depressed, too. Consequently both the microswitch 51 and the microswitch 43 are closed as their push members 52 and 44 are pushed down.

Figure 12:
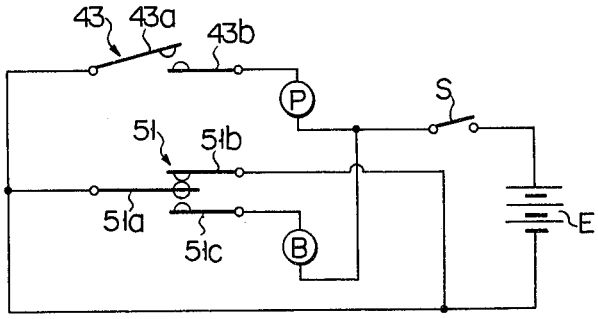
FIG. 12 is an electric circuit diagram of the foot switch shown in FIGS. 8 to 11.

The foot switch shown in FIGS. 8 to 11 has such an electric circuit including the microswitches 43 and 51 as illustrated in FIG. 12. The circuit comprises a power source E, a main switch S, a play switching section and a back space switching section. The play switching section consists of the microswitch 43 and a play switching circuit P, and the back space switching section consists of the microswitch 51 and a back space switching circuit B. The microswitch 43 is normally opened and is closed when its movable contact 43*a* is depressed by the member 44 to come into contact with its stationary contact 43*b*. The microswitch 51 is normally closed, and its movable contact 51*a* is normally in contact with its one stationary contact 51*b*. When the member 52 is depressed, the movable contact 51*a* comes into contact with the other stationary contact 51*c*.

When the back space tread plate 35 is treaded, the movable contact 51*a* of the microswitch 51 comes into contact with the stationary contact 51*c*. Simultaneously, the movable contact 43*a* of the microswitch 43 comes into contact with the stationary contact 43*b* since, as mentioned above, the play tread plate 43 is depressed too whenever the back space tread plate 51 is treaded. Thus the microswitch 43 is closed, but the play switching circuit P does not operate since the power supply is cut when the movable contact 51*a* of the microswitch 51 comes into contact with the stationary contact 51*c*.

It will now be explained how the foot switch shown in FIGS. 8 to 11 operates.

While the typist is treading the play tread plate 34, a transcriber, for example, connected to the foot switch keeps reproducing the information recorded on a tape. When he stops treading the plate 34, the transcriber stops reproducing the information. To cause the transcriber to start back spacing, the typist turns his heel a little to place his foot right above the back space tread plate 35 and then treads the plate 35.

More precisely, while depressed against the force of the springs 40*a* and 40*b*, the play tread plate 34 keeps depressing the push member 44 of the microswitch 43, thereby closing the microswitch 43. Thus the transcriber continues to reproduce the recorded information. When the typist stops treading the plate 34, the springs 40*a* and 40*b* push upward the plate 34 about the pins 39*a* and 39*b*. Then, since the push member 44 is no longer depressed, the microswitch 43 is opened, thereby causing the transcriber to stop reproducing the recorded information. To make the transcriber start back spacing, the typist treads the back space plate 35 to depress the push member 52 of the microswitch 51. When the member 52 is depressed, the movable contact 51*a* comes into contact with the stationary contact 51*c*, whereby the transcriber starts back spacing. The transcriber continues back spacing until the typist stops treading the back space tread plate 35.

When the play tread plate 34 is treaded, the back space tread plate 35 is never depressed. But when the back space tread plate 35 is treaded, the play tread plate 34 is depressed too for the aforementioned reason. In this case, however, both the play operation and the back spacing are never carried out. Only the back spacing is started since the play switching circuit P is opened.

In all the above-mentioned embodiments of this invention, a microswitch or microswitches are secured to the lower case and the push members of the switches are to be depressed by the tread plate or plates. Instead, they may be secured to the tread plate or plates so that their push members may be depressed by the bottom of the lower case.

What is claimed is:

1. A dual tread plate foot switch comprising:

a lower case made of a synthetic resin and having an integrally formed first engagement means;

a first tread plate made of a synthetic resin, the first tread plate being mounted to the lower case so as to be movable up and down with respect to the lower case, the first tread plate having an integrally formed second engagement means which is engageable with the first engagement means to prevent the first tread plate from disengaging from the lower case;

a first urging means for urging the first tread plate upwardly from the lower case;

a second tread plate cut out from the first tread plate and rockably hinged to the first tread plate;

a second urging means for urging the second tread plate upwardly from the lower case;

the first and second urging means being substantially independent of each other and both the first and second tread plates being moved downwardly against the upward urging force of both of the urging means when the second tread plate is pushed downward;

a first microswitch disposed between the first tread plate and the lower case and adapted to close when actuated by the first tread plate when the first tread plate is pushed downwardly relative to the lower case against the upwardly urging force of the first urging means; and a second microswitch adapted to close when actuated by the second tread plate when the second tread plate is pushed downwardly relative to the lower case against the upward urging force of the second urging means;

the first and second tread plates and their associated urging means and microswitches being arranged such that the second microswitch is prevented from being closed by the second tread plate when the first microswitch is closed by pushing only the first tread plate downwardly.

2. A foot switch according to claim 1, said first tread plate is box-shape with its underside open, said first tread plate loosely covering said lower case.

3. A foot switch according to claim 2, wherein said first tread plate and lower case are separate members.

4. A foot switch according to claim 2, wherein said first tread plate is hinged to said lower case and is rockable about a hinge portion which is formed of a synthetic resin integrally with said first tread plate and lower case.

5. A foot switch according to claim 1 or 4, wherein said second engagement means includes at least one strip protruding from said first tread plate toward the lower case and having on its end an engagement element; and said first engagement means includes at least one strip protruding from said lower case to face the strip of said second engagement means and having on its end an engagement element to engage the engagement element of said second engagement means.

6. A foot switch according to claim 5, wherein the strip of said second engagement means is elongated and is flexible, and includes a portion inclined to its longitudinal axis; and the strip of said first engagement means is flexible and is provided with a slit into which the inclined portion of said first engagement means elastically snaps.

7. A foot switch according to claim 4, wherein said first tread plate has an integrally formed support member protruding toward said lower case; said lower case has an integrally formed support member protruding to face the support member of said first tread plate, and said urging means includes a compression spring the ends of which are secured to the support members, respectively.

8. A foot switch according to claim 1, wherein said first tread plate has a pair of slits, and said second tread plate has a hinge portion between said slits whereat it is integrally hinged to said first tread plate, said second tread plate being rockable relative to said first tread plate about said hinge portion.

9. A foot switch according to claim 1 wherein said second tread plate is raised relative to said first tread plate.

10. A dual tread plate foot switch comprising:

a lower case made of a synthetic resin and having an integrally formed first engagement means;

a first tread plate made of a synthetic resin, the first tread plate being mounted to the lower case so as to be movable up and down with respect to the lower case, the first tread plate having an integrally formed second engagement means which is engageable with the first engagement means to prevent the first tread plate from disengaging from the lower case;

a first urging means for urging the first tread plate upwardly from the lower case;

a second tread plate cut out from the first tread plate and rockably hinged to the first tread plate;

a second urging means for urging the second tread plate upwardly from the lower case, the second urging means having a greater urging force than the first urging means;

a first microswitch disposed between the first tread plate and the lower case and adapted to close when actuated by the first tread plate when the first tread plate is pushed downwardly relative to the lower case against the upwardly urging force of the first urging means; and a second microswitch adapted to close when actuated by the second tread plate when the second tread plate is pushed downwardly relative to the lower case against the upward urging force of the second urging means;

the second urging means having a greater urging force than the first urging means for preventing the second microswitch from being closed by the second tread plate when the first microswitch is closed by pushing only the first tread plate downwardly.

11. A foot switch according to claim 10, wherein said first tread plate has a pair of slits, and said second tread plate has a hinge portion between said slits whereat it is integrally hinged to said first tread plate, said second tread plate being rockable relative to said first tread plate about said hinge portion.

12. A foot switch according to claim 10, wherein said second engagement means includes at least one strip protruding from said first tread plate toward the lower case and have on its end an engagement element; and said first engagement means includes at least one strip protruding from said lower case to face the strip of said second engagement means and having on its end an engagement element to engage the engagement element of said second engagement means.

13. A foot switch according to claim 12, wherein the strip of said second engagement is elongated and is flexible and includes a portion inclined to its longitudinal axis; and the strip of said first engagement means is flexible and is provided with a slit into which the inclined portion of said first engagement means elastically snaps.

14. A foot switch according to claim 10 wherein said second tread plate is raised relative to said first tread plate.

* * * * *